United States Patent [19]

Bisbing

[11] Patent Number: 4,705,308

[45] Date of Patent: Nov. 10, 1987

[54] DRAW PULL LATCH

[75] Inventor: Robert H. Bisbing, Delaware, Pa.

[73] Assignee: Southco, Inc., Concordville, Pa.

[21] Appl. No.: 860,450

[22] Filed: May 7, 1986

[51] Int. Cl.[4] ..... E05C 19/14

[52] U.S. Cl. ..... 292/108; 292/DIG. 38; 292/DIG. 49; 292/66; 292/256.69; 292/113; 292/109

[58] Field of Search ..... 292/246, 209, 113, 247, 292/DIG. 31, DIG. 38, DIG. 49, 66, 108, 109, 256.69

[56] References Cited

U.S. PATENT DOCUMENTS

| | | | |
|---|---|---|---|
| 342,502 | 5/1886 | Bennis | 292/209 |
| 427,233 | 5/1890 | Harrison | 292/247 |
| 484,235 | 10/1892 | Plunkett | 292/247 |
| 1,065,667 | 6/1913 | Donnell | 292/113 |
| 1,481,223 | 1/1924 | Gorman et al. | 292/247 |
| 2,241,437 | 5/1941 | Worthington | 292/209 |
| 2,605,123 | 7/1952 | Claud Mantle | 292/113 |
| 3,134,617 | 5/1964 | Slonneger | 292/DIG. 38 |
| 3,181,905 | 5/1965 | Bisbing | 292/DIG. 38 |
| 3,466,076 | 9/1969 | Bisbing | 292/DIG. 38 |
| 3,519,298 | 7/1970 | Gley et al. | 292/113 |
| 4,023,839 | 5/1977 | Bisbing | 292/DIG. 38 |

FOREIGN PATENT DOCUMENTS

| | | | |
|---|---|---|---|
| 1070044 | 11/1959 | Fed. Rep. of Germany | 292/247 |
| 696234 | 8/1953 | United Kingdom | 292/247 |

*Primary Examiner*—William F. Pate, III

*Assistant Examiner*—Michael Safavi

*Attorney, Agent, or Firm*—Paul & Paul

[57] ABSTRACT

A draw pull latch for securing two members together comprises a keeper affixed to one of the members and a second one-piece part which is composed of three segments; i.e., a base segment, an intermediate segment, and a locking segment. The base segment is adapted for being affixed to the second one of the members and the intermediate segment is flexibly connected to the base segment and the locking segment for pivotal movement of the segments about transverse axes. When in the locked condition, the intermediate segment is disposed in substantially coplanar relation to the base segment, and the locking segment is disposed in overlying relation to the base segment and the intermediate segment and to the keeper. The locking segment is detachably connected to the keeper, and the flexible connection between the intermediate and locking segments is closer to the second member than the flexible connection between the intermediate and base segments. The base segment has recesses in the sides thereof which mate with lugs in the cavity of the locking segment. A secondary locking feature is provided by use of an angular catch member disposed between the one-piece part and the second member and having a leg portion extending through the locking segment whereby the locking segment is retained in the latched condition. A finger notch is provided on the locking segment which, along with the outwardly extending edge of the catch member facilitates the opening of the latch, when desired.

8 Claims, 13 Drawing Figures

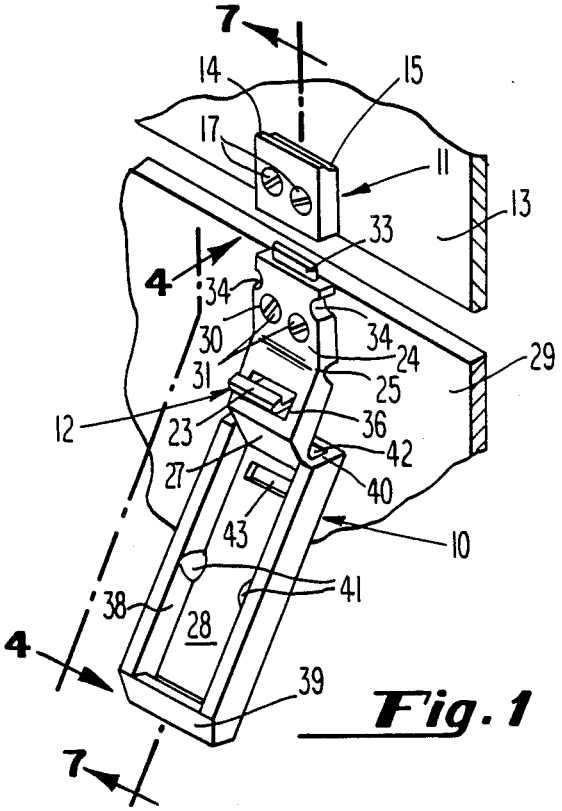
Fig. 1
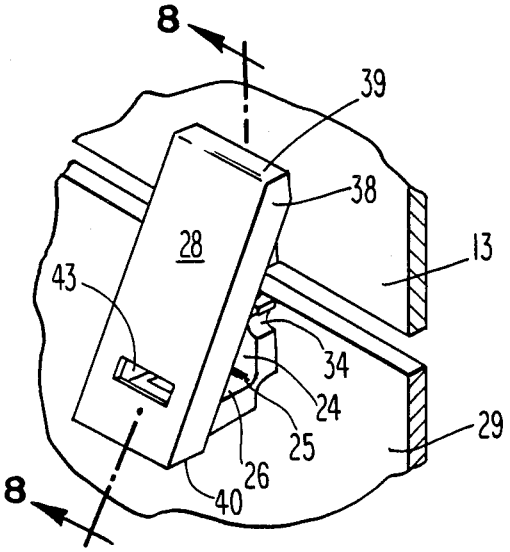
Fig. 2
Fig. 3
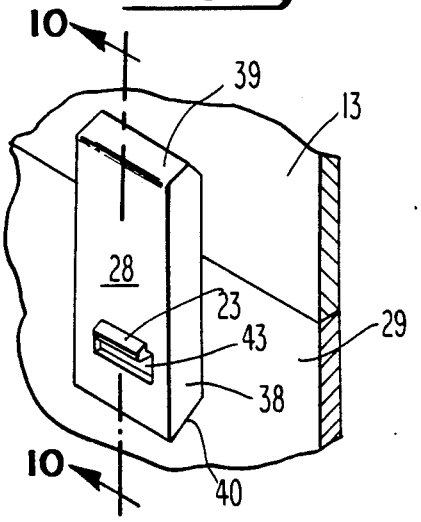
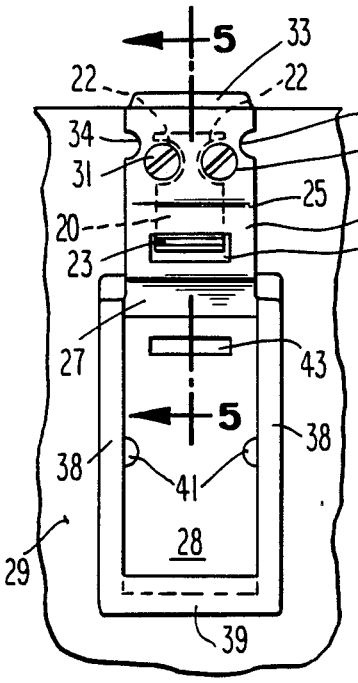
Fig. 4
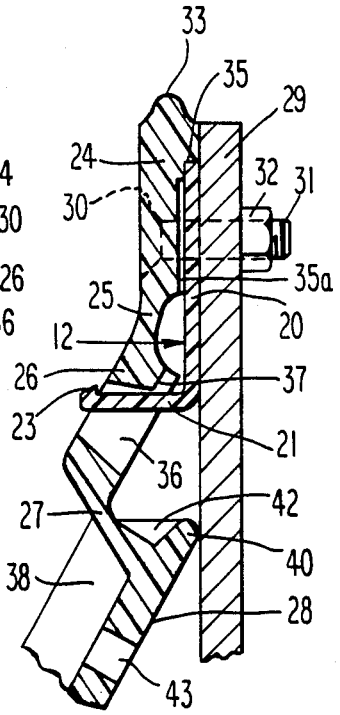
Fig. 5
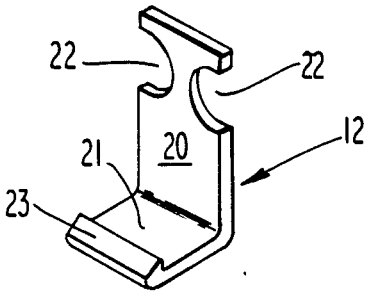
Fig. 6

DRAW PULL LATCH

BACKGROUND OF THE INVENTION

This invention relates to a latch for locking two members or panels together. More specifically, this invention relates to a draw pull latch of the type having one component formed with flexible segments so that upon proper engagement of the components and manual application of pressure, the latch draws together and locks the two panels.

My U.S. Pat. No. 3,181,905, issued May 4, 1965, discloses variations of a draw pull latch to which this invention relates. An improvement in this patented latch is taught in my U.S. Pat. No. 3,466,076, issued Sept. 9, 1969. The last mentioned patent teaches the use of interlocking lug and recess connections between the base and locking segments of the one-piece component to relieve the flexible connections between the segments of load stresses generated when the panels are secured together. The disclosures of these above-referenced patents are incorporatead herein by reference.

SUMMARY OF THE INVENTION

A primary object of the present invention is to provide an improvement in the type of latch mentioned above whereby the latch is more securely retained in the locked condition and also is easier to open, when desired.

According to one embodiment of the invention, this improvement is accomplished by providing a separate angular catch member which is mounted between the base segment and the second panel member, and which has a portion extending through the intermediate and locking segments of the one-piece part of the latch, said portion having a barbed end which engages the locking segment and retains the locking segment in the locked condition. The portion of the catch member extending through the segments is resiliently movable away from the face of the locking segment to disengage the barbed projection and allow the locking segment to be lifted to the unlocked position. A finger notch is provided on the locking segment to give a better grip on the locking segment. The opening of the latch is achieved by a squeezing action when the thumb is placed on the catch member and the index finger is engaged with the notch.

According to another embodiment of the invention, the angular catch member is provided with an opening at the end of the portion extending through the locking segment into which a security wire may be disposed to prevent the latch from being opened.

In still another embodiment of the invention, the catch member is provided with both a barbed end and an opening therethrough whereby a security wire may be used, if desired, and whereby the barbed end retains the locking segment in the locked condition even without the use of the security wire.

Accordingly, it is an object of the invention to provide in a latch which is constructed of a flexible material so that the latch is inexpensive to manufacture and yet effective to draw together and lock the two panels, an improvement which comprises an angular catch member comprising means for retaining the locking segment in the closed condition.

It is another object of the invention to provide a latch which is openable by a squeezing motion and includes a finger notch in the locking segment to provide a better grip.

These and other objects of the invention will become apparent upon a reading of the following detailed description with reference to the drawings, and the appended claims.

BRIEF DESCRIPTION OF THE DRAWINGS

FIG. 1 is a perspective view of the draw pull latch of this invention mounted on a pair of panels, showing the latch in the opened condition.

FIG. 2 is a perspective view of the mounted latch in the partially closed position.

FIG. 3 is a perspective view of the mounted latch in the fully closed position.

FIG. 4 is a partial front elevational view of the latch in the open position, showing the positioning of the catch member partially in phantom, and taken along line 4—4 of FIG. 1.

FIG. 5 is a partial cross-sectional view of the latch taken along the line 5—5 of FIG. 4.

FIG. 6 is a perspective view of one embodiment of the angular catch member of the invention having only a barbed end.

DETAILED DESCRIPTION OF THE EMBODIMENTS

Referring first to FIG. 1 of the drawings, one form of the draw pull latch assembly according to the invention is shown. The latch assembly comprises three basic components; a one-piece segmented part 10, a keeper 11, and a catch member 12.

Figure 7:
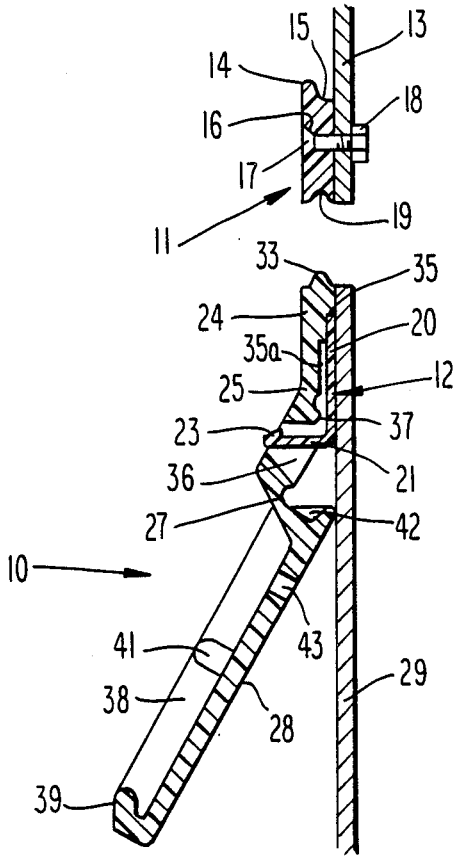
FIG. 7 is a sectional view of the mounted latch taken along line 7—7 of FIG. 1.

The keeper 11 is shown as being of a generally flattened cubical shape, but other suitable shapes are possible and the keeper 11 may also be formed integral with one panel member, such as panel 13. The keeper 11 is provided at one end with a flange 14 which extends the entire width of the keeper 11 adjacent the top surface thereof with a curved surface 15 below. Countersunk holes 16 are also provided so that keeper 11 can be securely fastened to panel 13 by screws 17 and nuts 18, or other conventional means (see FIG. 7). Keeper 11 has a centrally located groove 19 at the end opposite the extending flange 14 (see FIG. 7), the function of which will be described hereinbelow.

With reference to FIG. 6, catch member 12 comprises an angular member having an upstanding leg portion 20 and a short leg portion 21 disposed at substantially right angles to each other to form an L-shape. The upstanding leg portion 20 has a pair of oppositely facing mounting apertures 22 for the mounting of catch member 12 on the second panel member. Short leg portion 21 of catch member 12 has a barbed projection 23 at the terminal end thereof, which, as more fully described hereinafter, provides the secondary locking feature for this embodiment.

Figure 6A:
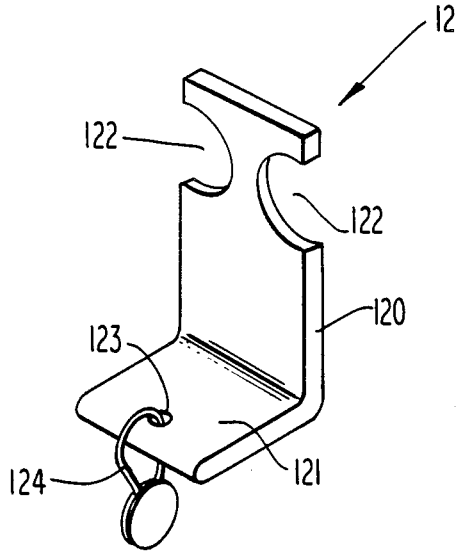
FIG. 6A is a perspective view of another embodiment of the catch member of the invention for use with a security wire.
Figure 6B:
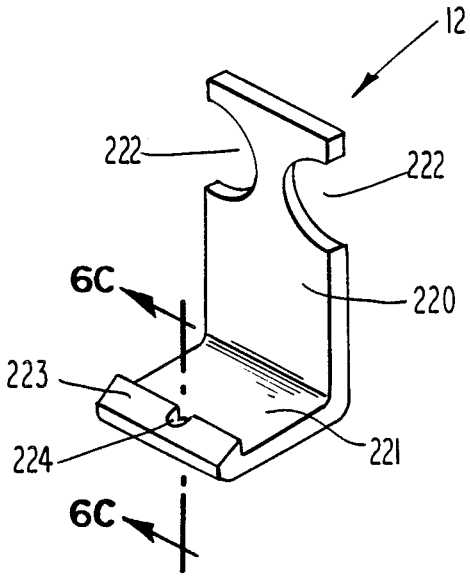
FIG. 6B is a perspective view of still another embodiment of the catch member of the invention having a barbed end and adapted for use with a security wire, if desired.
Figure 6C:
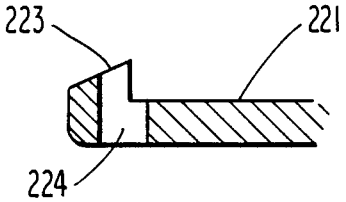
FIG. 6C is a sectional view of the embodiment of the catch member in FIG. 6B and taken along line C—C of FIG. 6B.

Alternate embodiments of the catch member 12 are illustrated in FIGS. 6A–6C. In the embodiment of FIG. 6A, the barbed end is eliminated and short leg portion 121 is provided with a hole 123 near the end thereof. A security wire, such as wire 124, may then be inserted through hole 123 to prevent the opening of the locking segment when the wire 124 is in place. The embodiment of FIGS. 6B and 6C is a combination of the above-referenced embodiments wherein short leg portion 221 is provided with a barbed end 223 and a hole 224. This embodiment has the advantage in that the barbed end 223 provides a retaining function for the latch and may also be provided with a security wire similar to that of FIG. 6A when extra security is desired.

The segmented part 10 is basically a one-piece, segmented part consisting of a base segment 24 joined by a thin, flexible connection 25 to an intermediate segment 26 which in turn is joined by another flexible connection 27 to a locking segment 28.

The base segment 24 is adapted to be affixed to the second panel member 29, and to this end base segment 24 is provided with countersunk holes 30, screws 31, and nuts 32. Other conventional fastening means are also possible to secure base segment 24 and thus segmented part 10 to the panel 29. A centrally located plug 33 is provided on the open end of base segment 24 and is of such dimension so as to be accepted by, and tightly held within, groove 19 of keeper 11 when the latch is closed (see FIG. 10). This plug and groove arrangement allows for correct alignment of the two panels and prevents undesirable lateral movement therebetween when engaged.

Spaced along the sides of base segment 24 are two substantially semicylindrical recesses 34, one on each side of base segment 24, formed perpendicular to the face of the base segment. The function of these recesses will be more fully described below in connection with the locking action.

With reference to FIG. 5, base segment 24 is provided with a shallow notch 35 on the upper end of the surface adjacent to panel member 29 and a slightly deeper recess **35*a* which extends downwardly along the back surface of base segment 24. Notch 35 is sized so as to receive a portion of upstanding leg 20 of catch member 12 so that, when mounted, the end of upstanding leg 20 above mounting apertures 22 is retained between base segment 24 and panel member 29, as shown. Recess 35*a* provides a clearance between upstanding leg 20 and base member 24 which allows upstanding leg 20 to flex towards base member 24 when short leg portion 21 is moved downwardly. The significance of this feature is more fully described below. The mounting apertures 22 of upstanding leg 20 are adapted to receive the boss projections (not shown) which circumscribe the holes 30 of base member 24, and thereby facilitate in mounting catch member 12 in position. (See FIG. 4**)

Figure 8:
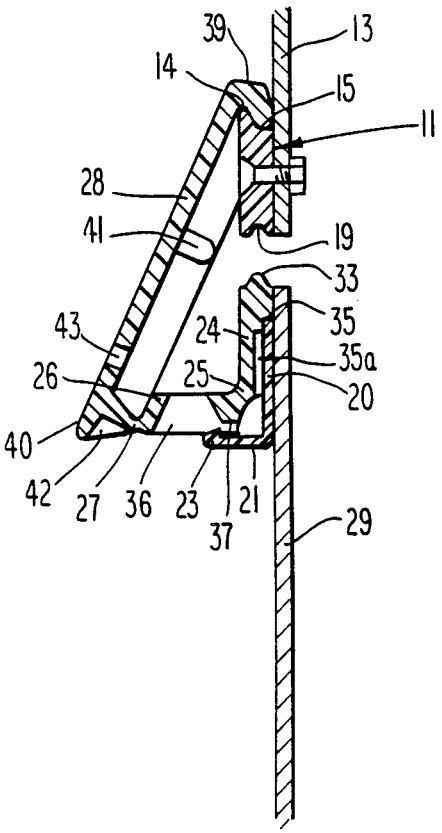
FIG. 8 is a sectional view of the mounted latch taken along line 8—8 of FIG. 2.
Figure 9:
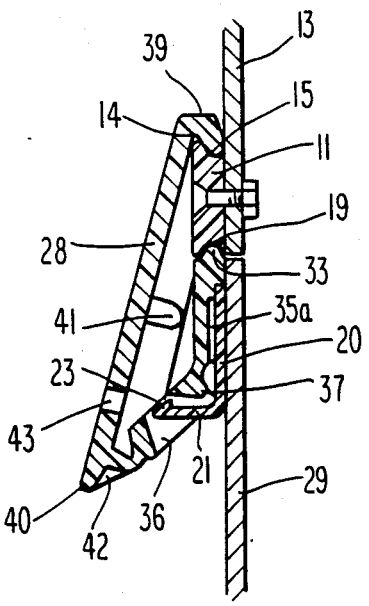
FIG. 9 is a sectional view of the mounted latch wherein the closing is more complete than in FIG. 8.
Figure 10:
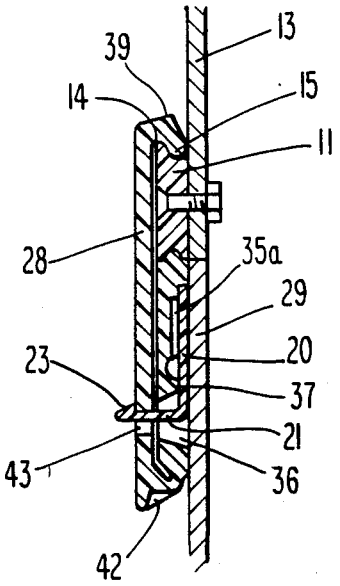
FIG. 10 is a sectional view of the mounted latch taken along line 10—10 of FIG. 3 showing the latch in fully closed position.

Intermediate segment 26 has a generally rectangular surface opening 36, which as seen in FIG. 8, opens inwardly to form a trapezoid shape in cross-section. Opening 36 is provided to allow short leg 21 and barbed projection 23 thereof to pass through intermediate segment 26 as the intermediate segment is pivoted about flexible connection 25 when the latch is being opened or closed. The clearance provided by opening 36 also allows short leg portion 21 to be moved downwardly to disengage the barbed projection from the face of the locking segment. With reference to FIG. 10, intermediate segment 26 has a support surface 37 which overlaps leg 20 of catch member 12 when the latch is closed. Support surface 37 provides support to the catch member 12 in the event that the latch is attempted to be opened without actuating the catch member, thus facilitating the retaining function of the catch member.

The locking segment 28 is generally box-shaped having longitudinal sides 38, a hooked end 39, and a lifting end 40. The hooked end 39 is designed to engage with the flange 14 and curved surface 15 of keeper 11 upon closing of the latch (See FIG. 8). Disposed within the interior of locking segment 28 on longitudinal sides 38 are a pair of substantilly semicylindrical lugs 41. Lugs 41 are positioned so as to be received by recesses 34 in base segment 24 when the latch is closed to relieve the flexible connections 25,27 from load stresses when the panels are secured together.

The lifting end 40 of locking segment 28 is provided with a finger notch recess 42 which extends substantially the width of the locking segment 28. The finger notch 42 provides an improved grip surface on the locking segment 28 when the latch is to be unlocked. Locking segment 28 is also provided with a rectangular slot 43 sized to receive the barbed end 23 or short leg 21 of the catch member 12. The slot 43 is positioned such that when locking segment 28 is fully closed, as seen in FIGS. 3 and 10, the barbed end 23 of the catch member is engaged with the face of the locking segment. In this position, the barbed projection 23 forms an effective retaining stop against the lifting of locking segment 28 to the open position.

From the locked condition illustrated in FIGS. 3 and 10, barbed projection 23 is pushed slightly downwardly by the thumb of the user to disengage the barbed projection from the face of locking segment 28. Simultaneously, the index finger of the user is in contact with the finger notch and the thumb and index finger are drawn together in a squeezing fashion to unlatch the locking segment. As barbed projection 23 and short leg 21 are moved downwardly, upstanding leg 20 flexes toward base member 24 into the clearance provided by recess **35*a*; that is, the catch member 12 is allowed to flex over its entire length. The importance of this feature is that if catch member 12 were not allowed to flexover its entire length, it would be necessary to make short leg 21 unreasonably thin in order to obtain the desired motion of barbed end 23** without subjecting the material to excessive bending stresses. This would be undesirable because the short leg portion would then be weak in tensile or holding strength and would not function properly.

Preferred embodiments of the invention have been described for purposes of illustration and are not to be construed as a limitation on the invention. It is to be understood that various modifications and alternatives may suggest themselves to those skilled in the art, all of which are within the spirit and scope of the invention as defined by the claims.

What is claimed is:

1. An over-center draw pull latch for use in securing two members together, comprising:

(a) a keeper adapted for being affixed to one of the members;

(b) a one-piece part having base, locking and intermediate segments, said base segment being adapted for being affixed to another one of the members, said intermediate segment being flexibly connected to said base and locking segments for pivotal movement of said segments about transverse axes, and when in a locked condition said intermediate segment being disposed in substantially coplanar relation to said base segment and said locking segment being disposed in overlying relation to said base and intermediate segments and to said keeper, said locking segment being detachably connected to said keeper, and the flexible connection between said intermediate and locking segments being closer to said another one of the members than the flexible connection between said intermediate and base segments when in the locked condition, thereby comprising over-center means;

(c) a catch member having a long portion and a short portion disposed at generally right angles to one another, said long portion having a mounting region remote from said short portion, said mounting region being adapted for being positioned between said base segment and said another one of the members when said one-piece part is affixed to said another one of the members, said base segment being adapted to receive said mounting region of said catch member and to retain said long portion substantially adjacent to said another one of the members, said short portion having a barbed projection at an end remote from said long portion, said short portion being disposed to pass through said intermediate and locking segments when the latch is in a locked condition, said intermediate segment having an aperture therein positioned and sized so as to permit the passage of said short portion when said latch is moved to said locked condition, said locking segment having an aperture positioned and sized so as to contact said barbed projection when said latch is moved to said locked condition and to contact said barbed projection when in the locked condition whereby said locking segment is retained in said condition by said catch member, wherein said short portion is resiliently movable away from said locking segment to disengage sid barbed projection whereby said locking segment can be manually lifted to an unlocked condition; and (d) wherein upon movement of said short portion away from said locking segment, said long portion of said catch member flexes outwardly towards said base segment, wherein said base segment is adapted to receive said long portion when said long portion is in the flexed condition, wherein said apertures in said intermediate and locking segments are sized so as to provide clearance for the movement of said short portion, and wherein the disengagement of said barbed projection is without mechanical affect on the connection between said locking segment and said keeper.

2. The latch of claim 1, wherein said barbed projection is provided with a transverse hole adapted to receive a security wire therethrough.

3. The latch of claim 1, further comprising stress relieving means disposed on said locking segment and said base segment for relieving the stress on said flexible connections.

4. The latch of claim 3, wherein said stress relieving means comprises a pair of substantially semicylindrical lugs oppositely disposed with respect to one another within said locking segment and a pair of substantially semicylindrical recesses oppositely disposed with respect to one another in said base segment so as to engage said lugs upon closing of said latch.

5. The latch of claim 1, wherein said locking segment is provided with a notched recess in an end closest to the flexible connection with said intermediate segment whereby said latch is unlocked by a squeezing action.

6. The latch of claim 1, wherein said base segment is provided with a plug and said keeper is provided with a groove, said plug and said groove being positioned on opposing surfaces of said base segment and said keeper whereby upon locking of the latch, said plug enters said groove and is held therein against lateral movement.

7. The latch of claim 1, wherein said base segment is provided with a notch on a surface thereof adapted to receive the mounting region of said long portion of said catch member and a recess generally adjacent to said notch sized to provide clearance for the long portion when said long portion is in said flexed condition.

8. The latch of claim 7, wherein said apertures in said intermediate and locking segments are substantially rectangular-shaped.

* * * * *